US007025625B2

(12) United States Patent
Kai

(10) Patent No.: US 7,025,625 B2
(45) Date of Patent: Apr. 11, 2006

(54) PRINTED CIRCUIT BOARD CONNECTOR

(75) Inventor: Chang-Chin Kai, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/859,201

(22) Filed: Jun. 3, 2004

(65) Prior Publication Data

US 2005/0272302 A1 Dec. 8, 2005

(51) Int. Cl.
*H01R 12/24* (2006.01)

(52) U.S. Cl. ..... 439/495

(58) Field of Classification Search ..... 439/495, 439/492, 67, 77, 260, 329
See application file for complete search history.

(56) References Cited

U.S. PATENT DOCUMENTS 3,149,896 A * 9/1964 Hall ..... 439/329
4,639,063 A * 1/1987 Mueller ..... 439/325
4,700,997 A * 10/1987 Strand ..... 439/372
4,761,143 A * 8/1988 Owens et al. ..... 439/372
4,768,969 A * 9/1988 Bauer et al. ..... 439/260
4,936,792 A * 6/1990 Onoue et al. ..... 439/329
5,211,577 A * 5/1993 Daugherty ..... 439/493
5,470,246 A * 11/1995 Mosquera ..... 439/260

* cited by examiner

*Primary Examiner*—Neil Abrams
(74) *Attorney, Agent, or Firm*—Jiang Chyun IP Office

(57) ABSTRACT

A thin, low profile, printed circuit board connector is constituted of a chassis, having a terminal receiver and a lid set on the terminal receiver, wherein a base of the chassis comprises a plurality of terminals penetrated there-through, and the base comprises a sidewall at two sides thereof, and wherein said sidewall has a track for fitting the lid. A buckling element is fitted in the track of the sidewalls of the base such that the base portion of the buckling element can slide along the slope having a lower height towards a higher height, and thus wherein said buckling element can press the top surface of the lid to against and position the flexible circuit board between the two sidewalls.

13 Claims, 9 Drawing Sheets

PRINTED CIRCUIT BOARD CONNECTOR

BACKGROUND OF THE INVENTION

1. The Field of the Invention

The present invention relates to a connector, and more particularly to a printed circuit board connector wherein a lid disposed between two inner sidewalls of a terminal receiver is securely positioned onto the terminal receiver for substantially securing the flexible (printed) circuit board there between.

2. Description of the Related Art

With the rapid development in computer and electronic technology, smaller, compact, thinner, portable and lighter electronic devices, such as the palm computer, notepad and notebook computer, are presently available and quite popular on the market. The latest electronic products, namely, cellular phone and PDA, are designed to fit the current requirement of being smaller, compact, thinner, portable and lighter. For meeting such requirements, the structure of the internal elements of the circuit board are required to be smaller and more precise, and also must be capable of reinforcing the structural characteristics, especially, a thin connector, for example, a FPC, flexible printed circuit, connector with a 0.3 pitch has been developed. However the lid and the chassis of FPC connector are small, thin and delicate. When such thin, low profile, FPC connector is applied to a circuit board, the thin FPC connector and other electronic devices on the circuit board can easily get damaged due to the external impact while disassembling. Referring to FIGS. 8, 9, 10 and 11, an elevational view of before and after assembling of a conventional connector, and a sectional side view of before and after assembling of the conventional connector, are shown. As shown, the tongue B positioned in the groove A2 of the base A is pulled out, and then the flexible circuit board D is pushed into the groove A2 of the base A until the flexible circuit board D for electrically contacting the flexible circuit board D with the terminals C. Next, the tongue B is pushed back into the groove A2 to fit the two suspended arms B1 of the tongue B into the track A1 of the base A. Thus, the flexible circuit board D is clamped tightly between the terminals C and the tongue B and the assembly is completed. To remove the flexible circuit board D, the tongue B is pulled out. However, such a conventional connector has several defects, for example:

1. The space occupied on the motherboard is relatively large then the industrials expect, and this needs to be improved.
2. Because the conventional connector needs a track for pushing the tongue into the groove, and an isolation support for supporting the terminals, therefore the profile is difficult to be reduced.
3. The flexible circuit board is inserted into the connector from the edge, and it would be difficult if there are lots of components closed to the connector, but it happens for the electrical devices were minimized.

Referring to FIG. 12, an elevational view of another conventional connector is shown. As shown, the lid E comprises two arms E1 having a protruding axle E11 outward respectively, and the axles E11 are adapted to be disposed and slid-able in the axial holes F3, formed at two ends of the case F2 of the connector F. During pivoting the lid E to the locked position form the opening position, through the closed position, the arm E1 is pivoted downward into the groove F4 and the lid E is pushed backward to let two supporting plates E2, protruding from the lid E, fitted in the positioning groove F12, formed abut two ends of a groove F11, exposing a part of terminals for electrical contact with the flexible printed circuit G. Therefore, when placing the flexible printed circuit G into the groove F11 of the base F1 in the connector F, the arms E1 can be buckled into the groove F4 by two supporting plate E2, locked into the positioning groove F12 at the locked position of the lid E. However, there are at least the following defects in the conventional connected described above.

1. The lid E slides in the axial hole F3 by the axles E11 if the position of the axles E11 in the axial hole F3 is not proper, and the lid E is unable to be pivoted from the opening position, and the supporting plates E2 of the lid E will not be able to reach the positioning groove F12 of the connector F, thus the lid E can not be locked.
2. For locking the lid E to the locked position, the supporting plates E2 have to be pushed into the positioning groove F12, if the lid E is not pivoted to the proper position, the supporting plates E2 will get out of shape due to being pressed on the connector F.

Therefore, to solve the above defects of the conventional connectors is an important issue for the manufacturer in the field.

SUMMARY OF THE INVENTION

According to an aspect of the present invention, the occupation for the thing, low profile, connector should be reduced.

According to another aspect of the present invention, the flexible printed circuit board could be assembled into the thin, low profile, connector by an easy and reliable assembling method.

To archive the said aspects, the thin, low profile, connector comprising a chassis, having a terminal receiver, for receiving terminals, and a lid pivoted in the terminal receiver, for pushing a flexible printed circuit board against the terminals, and a buckling element, locking the lid at an predetermined position. Therefore, a flexible printed circuit board inserted in the present invention, the lid was pivoted, pushing the flexible printed circuit board against the terminals in the terminal receiver, and the buckling element was moved for locking the lid at a particular attitude, pushing the flexible printed circuit board against the terminals in the terminal receiver.

BRIEF DESCRIPTION OF THE DRAWING

For a more complete understanding of the present invention, reference will now be made to the following detailed description of preferred embodiments with the following accompanying drawings.

DETAILED DESCRIPTION OF PREFERRED EMBODIMENTS

Figure 1:
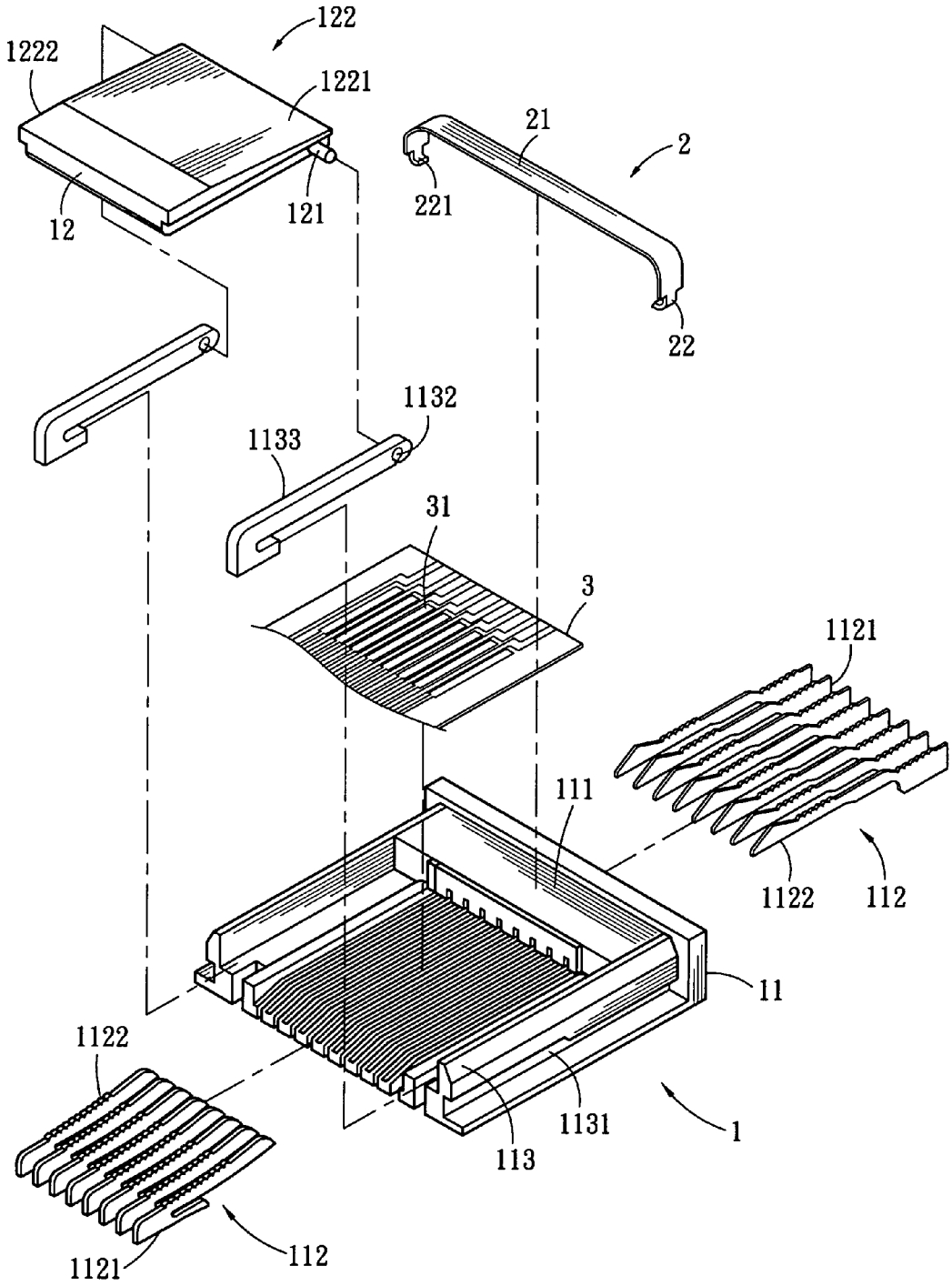
FIG. 1 is an exploded view of a connector according to a preferred embodiment of the present invention.
Figure 2:
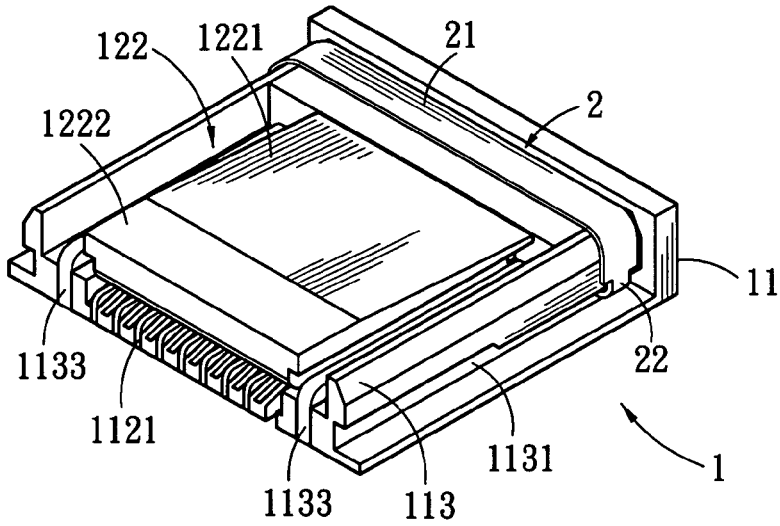
FIG. 2 is an elevational view of a connector according to a preferred embodiment of the present invention.
Figure 3:
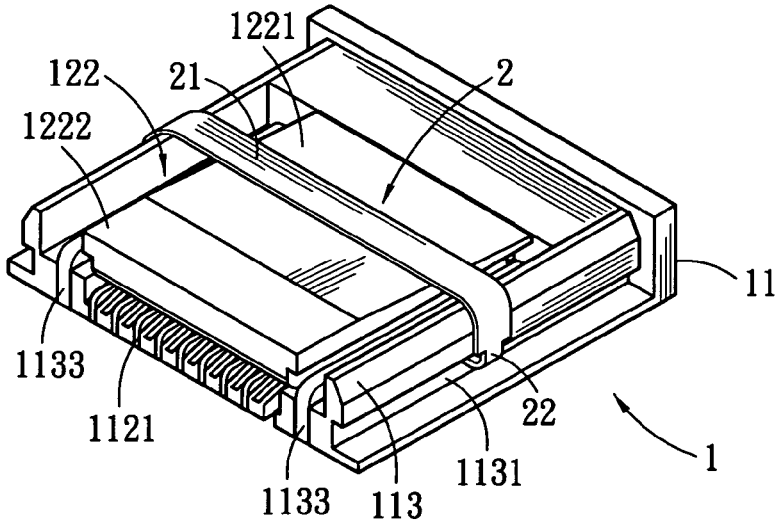
FIG. 3 is an elevational view of a buckling element buckled in a position on a lid of a connector according to a preferred embodiment of the present invention.
Figure 4:
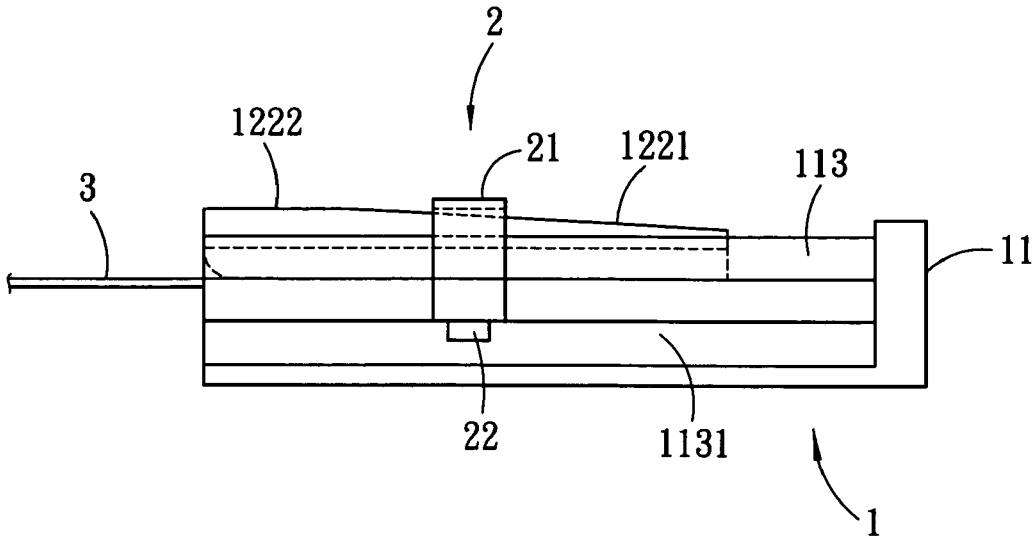
FIG. 4 is a side view showing while pushing the buckling element onto a lid of a connector according to a preferred embodiment of the present invention.
Figure 5:
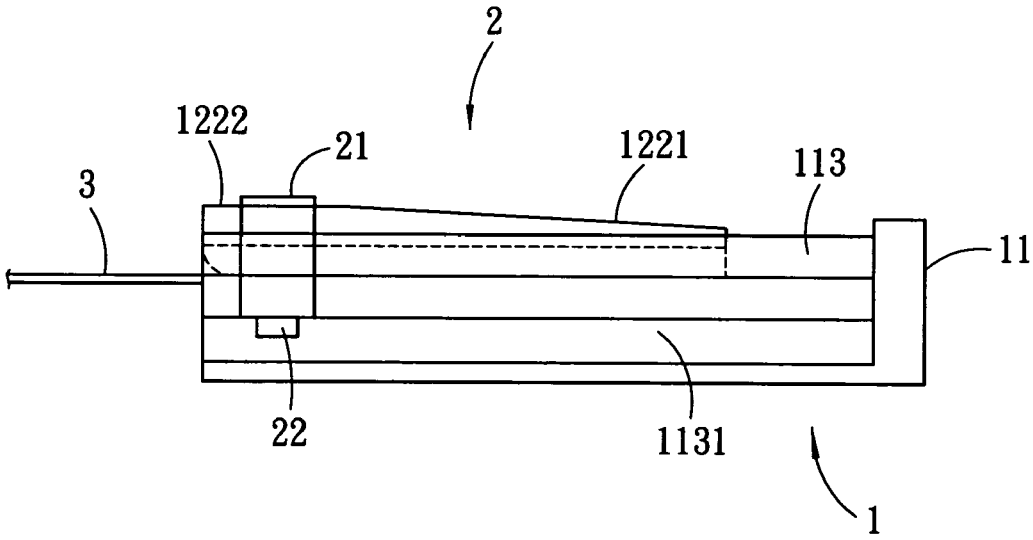
FIG. 5 is a side view showing after pushing the buckling element onto a lid of a connector according to a preferred embodiment of the present invention.
Figure 6:
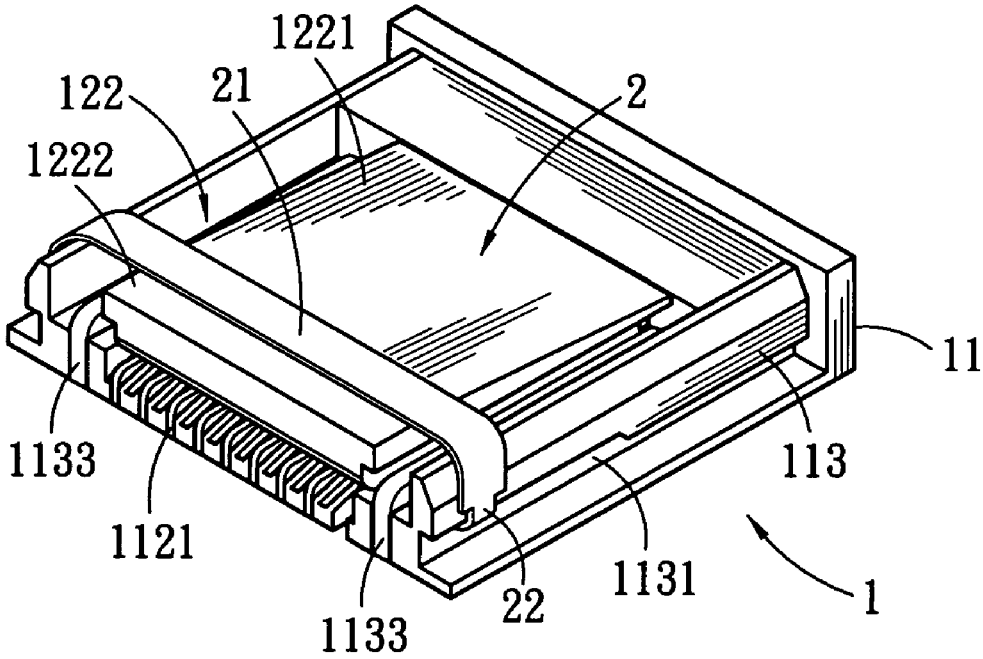
FIG. 6 is an elevational view of the buckling element buckled onto another position of a connector according to a preferred embodiment of the present invention.

Referring to FIGS. 1 and 2, an exploded view and an elevational view of a connector according to a preferred embodiment of the present invention are respectively shown. The connector of the present invention comprises a chassis 1 and a buckling element 2, slid-ably disposed on the chassis 1.

The chassis 1 has a terminal receiver 11 and a lid 12 set on the terminal receiver 11. The terminal receiver 11 has a base 111 having a plurality of terminals 112 penetrated there-through. Each of the two opposite ends of the base 111 has a sidewall 113, with a track 1131 and a supporting arm 1133, with an axial hole 1132, in the terminal receiver 11.

A lid 12 having two sides, each protruding an axle 121 outward, and a top surface 122 with an slope 1221 and a supporting face 1222, a highest surface of the top surface 122 of the lid 12 and abut an end of the slope 1221. The two axles are disposed in each axial hole 1132 of the supporting arms 1133, making the lid 12 pivotable in the terminal receiver 11. It is obvious for anyone who is skilled in the art to modify this design by omitting the supporting arms 1133 and apply axial holes 1132 to the inner surface of the two side walls 113 and this modify shall be read as an equivalent embodiment of this prefer embodiment.

There are terminals 112, disposed through the base 111, having plurality of terminals 112 thereon extending from a frontal portion or the rear portion penetrating through the base 111, wherein the terminals 112 and the base 111 can be fitted, attached, buckled or integrally formed as a unit. The terminal 112 has a welding end 1121 extending at the frontal portion of the base 111 and an adapting end 1122 protruding upward for electrical connecting the circuit contact surface 31 of the flexible circuit board 3.

The buckling element 2 having a base portion 21 with two buckling portions 22, bent downwardly at each end, and the distal ends of the buckling portions 22 are buckles 221, curved toward each other. The base portion 21 of the buckling element 2 was slid-able on top surface 122 of the lid 12, and two buckles 221 are disposed in the tracks 1131 of the two sidewalls 113 and the buckling element 2 is capable for sliding along the track 1131 of the two sidewalls 113 by the buckling portion 22 formed at the two ends.

Pivoting the lid 2 on, the flexible circuit board 3 can be placed between the two sidewalls 113, and the circuit contact faces 31 of the flexible circuit board 3 are set on the adapting end 1122 of the terminals 112 for making the electrical contact, pivoting the lid 12 off and pushing the base portion 21 of the buckling element 2 toward the supporting face 1222 of the lid 12 for locking the flexible circuit board 3 in the connector. The pressure applied to the top surface 122 of the lid 12 by the base portion 21 of the buckling element 2 is getting stronger during the base portion 21 sliding along the slope 1221, for the buckles 221 in the track 1131, and becoming a constant after the base portion 21 of the buckling element 2 sliding over the slope 1221.

It is to be noted that the lid 12 will not interfere with the electrical connection of the flexible circuit board 3 and the plurality of terminals 112 directly and the flexible circuit board 3 is securely positioned and covered by the lid 12.

Now referring to FIGS. 3, 4, 5 and 6, an elevational view of a buckling element buckled in a position on the lid of the connector, a side view showing while and after pushing the buckling element onto the lid, and an elevational view of the buckling element buckled onto another position of the connector, according to the preferred embodiment of the present invention are respectively shown. After placing the flexible circuit board 3 onto the terminal receiver 11, the lid 12, between the two sidewalls 113 of the terminal receiver 11, is pivoted to cover the flexible circuit board 3, and the buckling element 2 is slid forward in the tracks 1131 of the two sidewalls 113. Meanwhile, the base portion 21 of the buckling element 2 slides along the slope 1221 having a lower height towards a higher height, therefore the buckling element 2 can substantially press the lid 12 against the flexible circuit board 3 between the two sidewalls 113 to securely position the flexible circuit board 3 between the lid 12 and the terminal receiver 11 and also for preventing the lid 12 come loose.

The above-mentioned slope 1221 of the top face 122 of the lid 12 has a supporting face 1222 on the upper portion for making the buckling element 2 to apply more pressure to making the lid 12 presses against the flexible circuit board 3 harder within the terminal receiver 11. Therefore, the flexible circuit board 3 positioned between the terminal receivers 11 and pressed by the lid 12, and the flexible circuit board 3 can be securely positioned, and the lid 12 can be substantially positioned over the terminal receiver 11 without having the risk of flinging up.

Additionally, the terminal receiver 11, the lid 12 of the chassis 1 and buckling element 2 are being guided by the slope 1221 of the lid 12, wherein the buckling element 2 is stretched elastically to press against the slope 1221 by pushing sliding the buckling element 2 over the slope 1221. The buckling element 2 can be made of resilient plastic or metallic material.

The chassis 1 and the lid 12 need not be slidably engaged with each other, thus the terminal receiver 11 and the lid 12 will not rub against each other causing damage to each other.

Figure 7:
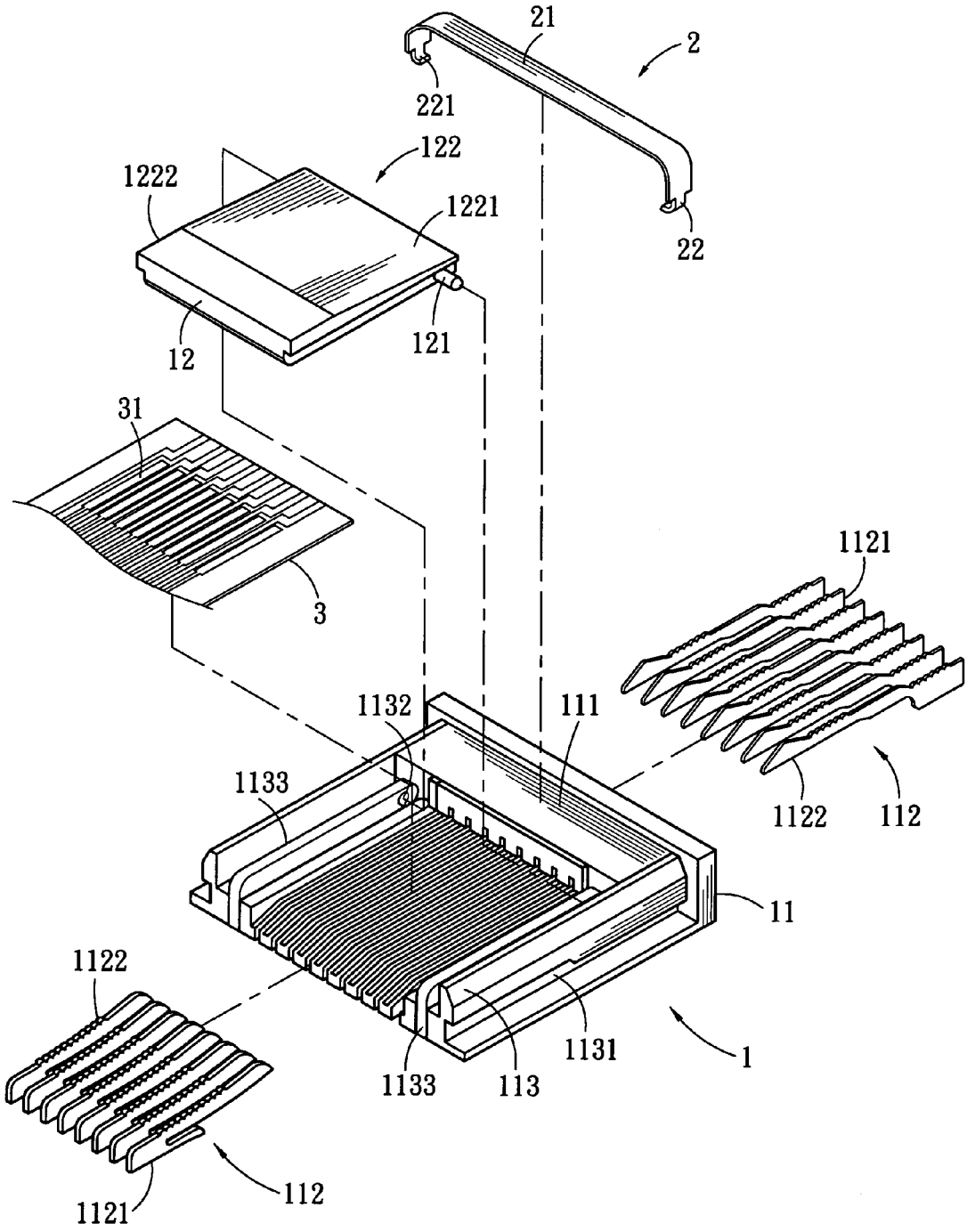
FIG. 7 is an exploded view of a connector according to another preferred embodiment of the present invention.
Figure 8:
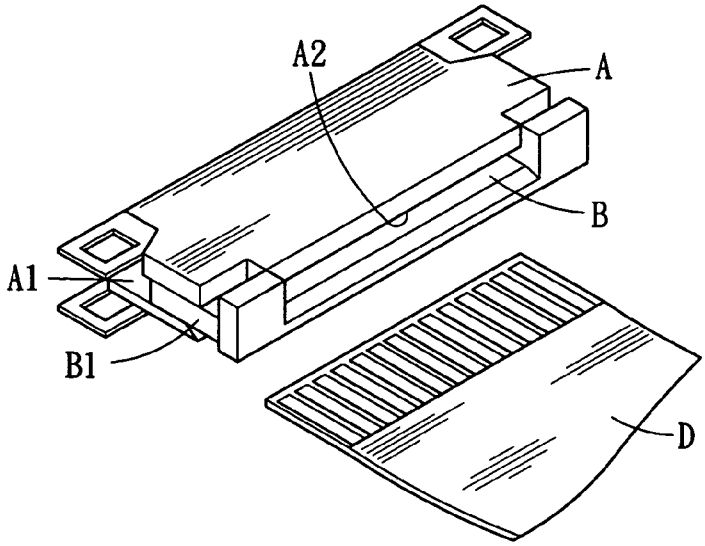
PRIOR ART FIG.8
FIG. 8 is an elevational view showing before assembly of a conventional connector.
Figure 9:
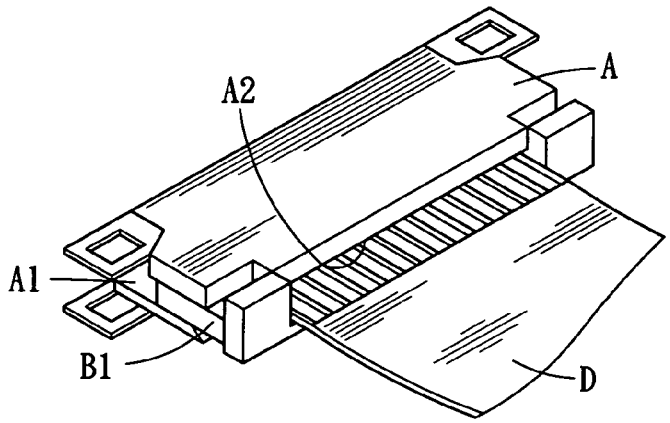
PRIOR ART FIG.9
FIG. 9 is an elevational view showing after assembly of the conventional connector.
Figure 10:
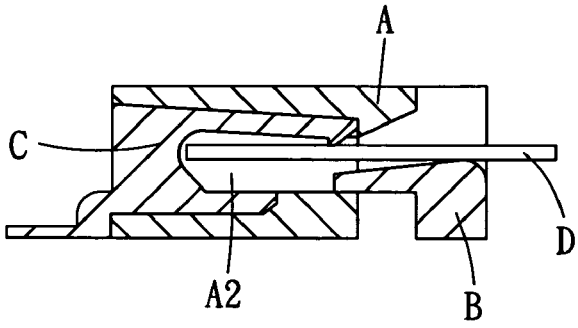
PRIOR ART FIG. 10
FIG. 10 is a sectional side view showing before assembly of the conventional connector.
Figure 11:
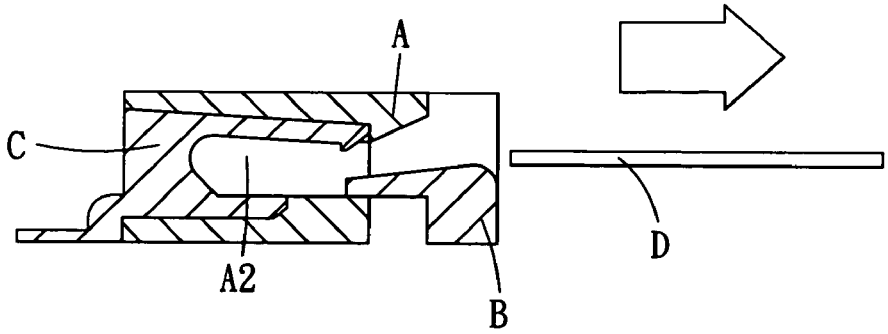
PRIOR ART FIG. 11
FIG. 11 is a sectional side view showing after assembly of the conventional connector.
Figure 12:
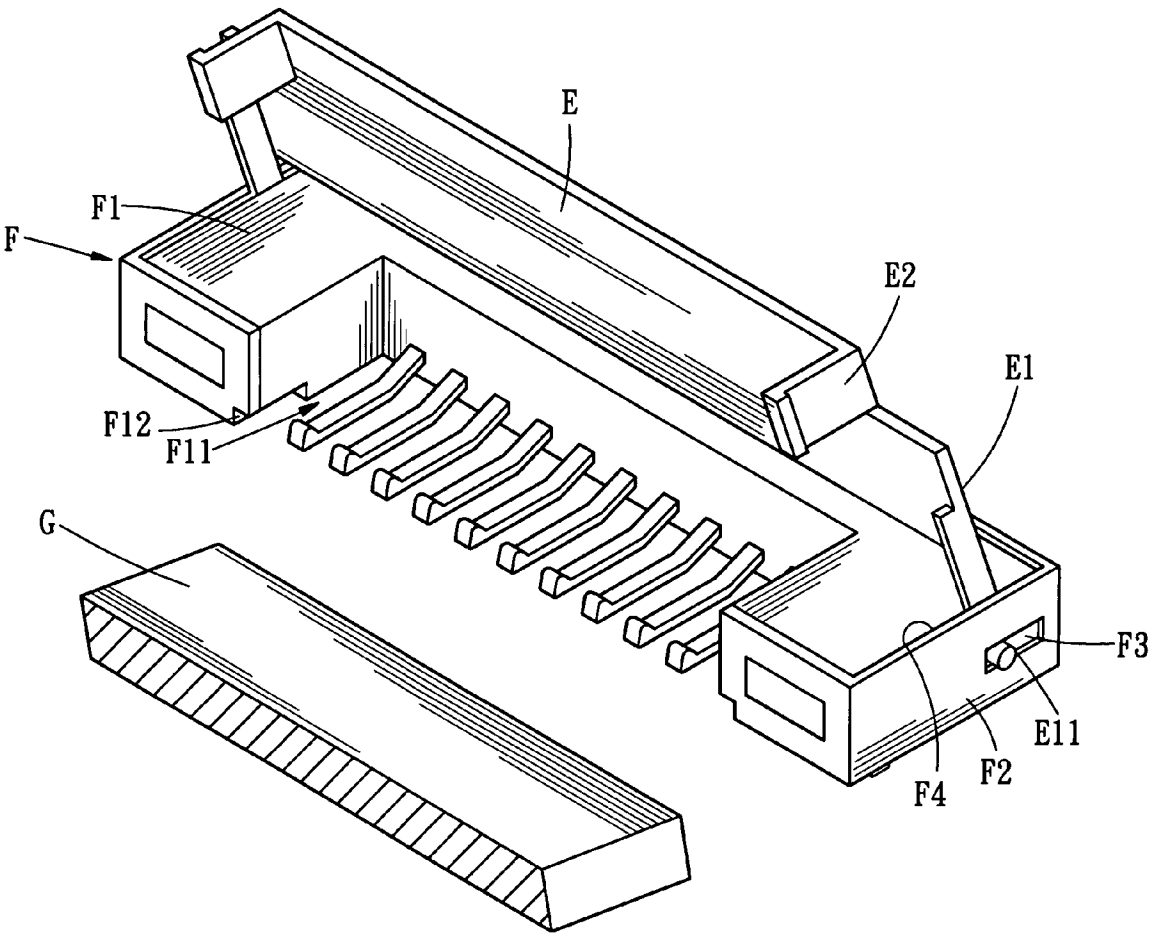
PRIOR ART FIG. 12
FIG. 12 is an elevational view of another conventional connector.
Figure 13:
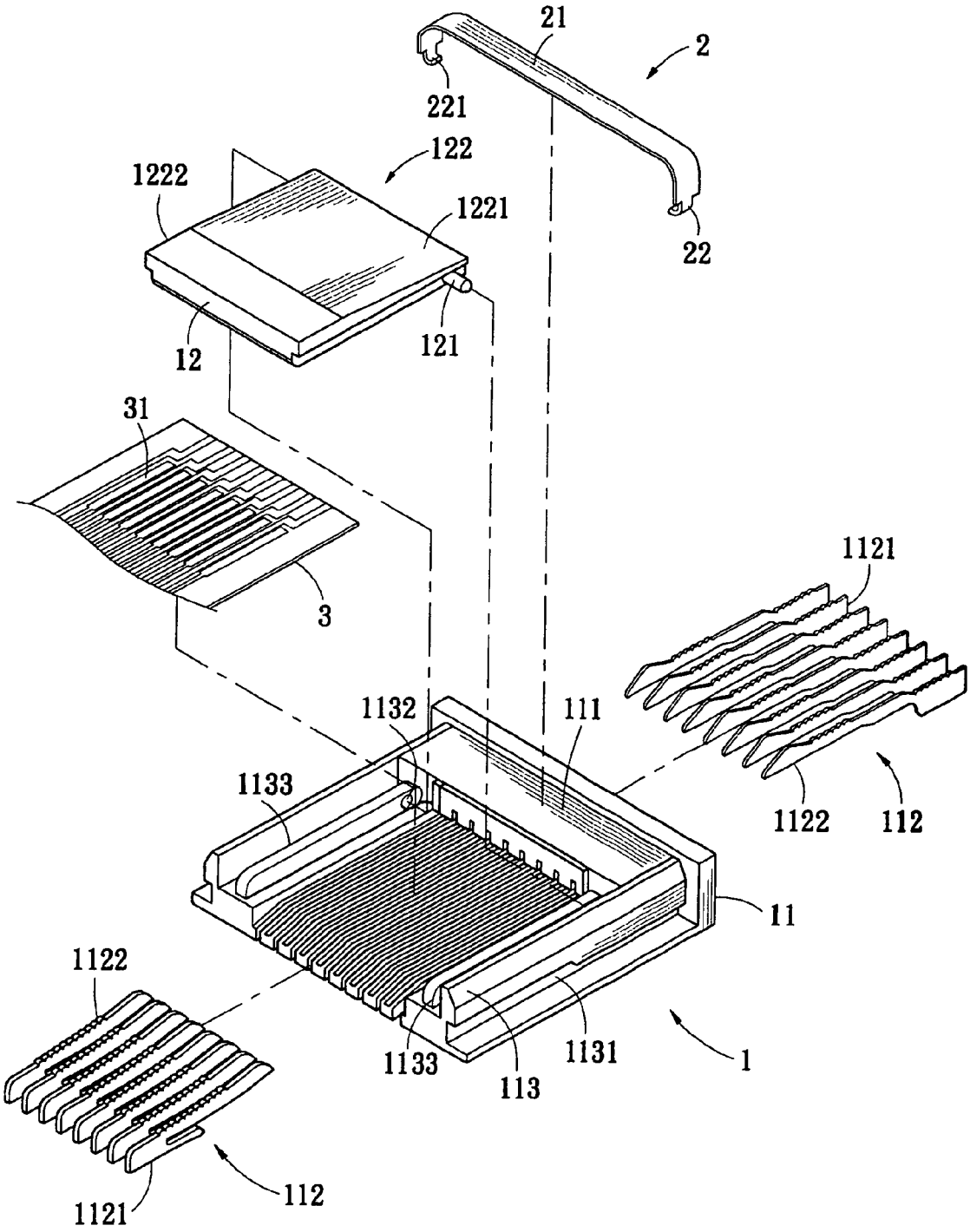
FIG. 13 is an exploded view of a connector according to another preferred embodiment of the present invention.

Furthermore, FIGS. 1 and 7, an exploded view of a connector according to a preferred embodiment and another preferred embodiment of the present invention respectively. As shown, the two sidewalls 113 of the terminal receiver 11 of the chassis 1 have the supporting arms 1133 that can be made of metallic and buckled to the terminal receiver 11 between two sidewalls 113, wherein the supporting arms 1133 can be tighten, connected, welded or made as an integral unit with the terminal receiver 11. And by using the supporting arm 1133 the terminal receiver 11 can be connected to the ground.

The present invention has a lid and a buckling element which is slid-ably set over the terminal receiver and the flexible circuit board can be clamped in the terminal receiver by the lid and the base. By sliding the buckling element on the lid, the lid is pressed down to the flexible circuit board to securely position the flexible circuit board between the lid and the terminal receiver.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

The invention claimed is:

1. A printed circuit board connector, comprising:

a chassis, having a terminal receiver, for receiving terminals, a lid, having two axles at two opposite side for pivoting in the terminal receiver and pushing a flexible printed circuit board against the terminals in the terminal receiver, a base, penetrated there-through by said terminals, two sidewalls, having axle holes for said two opposite axles of the lid and tracks at each sidewall;

a buckling element, capable of sliding between two sidewalls of said base, having a base portion, and two buckling portion, bent downwardly at each ends of the base, fitted in said track of said two sidewalls, therefore, the top surface of the lid is pressed by said buckling element for pressing a flexible printed circuit board downwardly against said terminals.

2. The printed circuit board connector according to claim 1, wherein said plurality of terminals penetrates through said base is fitted from a frontal portion of said base.

3. The printed circuit board connector according to claim 1, wherein said plurality of terminals penetrates through said base is fitted in from a rear portion of said base for positioning.

4. The printed circuit board connector according to claim 1, wherein said terminal receiver comprises a supporting arm set at an inner side of said two sidewalls thereof.

5. The printed circuit board connector according to claim 4, wherein said supporting arm set at said inner side of said two sidewalls of said terminal receiver can be fitted to thereof.

6. The printed circuit board connector according to claim 4, wherein said supporting arm set at said inner side of said two sidewalls of said terminal receiver can be tightened to thereof.

7. The printed circuit board connector according to claim 4, wherein said supporting arm is integrally formed with said terminal receiver.

8. The printed circuit board connector according to claim 4, wherein said supporting arm set comprises an axial hole formed at an end closest to said base for fitting axles positioned at two sides of said lid.

9. The printed circuit board connector according to claim 1, wherein a profile of said top surface of said lid is comprised of a slope, wherein a height of the slope increases from said axle side towards other side, and wherein a supporting face is formed at an upper portion thereof.

10. The printed circuit board connector according to claim 9, wherein said supporting face formed at said upper portion of said top surface is a slope.

11. The printed circuit board connector according to claim 9, wherein said supporting face formed at said upper portion of said top surface is a non-sloped plane.

12. The printed circuit board connector according to claim 1, wherein said buckling element is made of elastic metallic material.

13. The printed circuit board connector according to claim 1, wherein said buckling element is made of elastic plastic material.

* * * * *